US010965048B2

(12) United States Patent
Thörner

(10) Patent No.: US 10,965,048 B2
(45) Date of Patent: Mar. 30, 2021

(54) METHOD FOR PRODUCING A CONTACT ELEMENT

(71) Applicant: Wolfgang B. Thörner, Essen (DE)

(72) Inventor: Wolfgang B. Thörner, Essen (DE)

(73) Assignee: Wolfgang B. Thorner, Essen (DE)

( * ) Notice: Subject to any disclaimer, the term of this patent is extended or adjusted under 35 U.S.C. 154(b) by 0 days.

(21) Appl. No.: 15/114,960

(22) PCT Filed: Jan. 27, 2015

(86) PCT No.: PCT/EP2015/051578
§ 371 (c)(1),
(2) Date: Jul. 28, 2016

(87) PCT Pub. No.: WO2015/113959
PCT Pub. Date: Aug. 6, 2015

(65) Prior Publication Data

US 2016/0344125 A1 Nov. 24, 2016

(30) Foreign Application Priority Data

Jan. 28, 2014 (DE) ..... 10 2014 000 910.6
Apr. 11, 2014 (DE) ..... 10 2014 005 339.3

(51) Int. Cl.
*H01R 13/405* (2006.01)
*H01R 13/03* (2006.01)
*H01R 43/16* (2006.01)

(52) U.S. Cl.
CPC ..... *H01R 13/03* (2013.01); *H01R 43/16* (2013.01)

(58) Field of Classification Search
CPC ..... H01R 43/16; H01R 13/03
(Continued)

(56) References Cited

U.S. PATENT DOCUMENTS 2,022,314 A 11/1935 Heyroth et al.
2,446,706 A * 8/1948 Smith ..... H01R 24/566 174/21 CA (Continued)

FOREIGN PATENT DOCUMENTS

CN 101527400 A 9/2009

OTHER PUBLICATIONS

International Search Report of the International Searching Authority with English Translation issued in the corresponding PCT International Application No. PCT/EP2015/051578, dated May 29, 2015 (7 pages).

(Continued)

*Primary Examiner* — Abdullah A Riyami
*Assistant Examiner* — Nader J Alhawamdeh
(74) *Attorney, Agent, or Firm* — Adams and Reese LLP; Raymond R. Ferrera

(57) ABSTRACT

The invention relates to a method for producing a contact element (3) of an electrical plug connector (1), said method comprising the following steps:

providing an electrically non-conductive carrier element (4), and coating the carrier element (4) with an electrically conductive material, wherein the produced coating (6) forms the only electrical signal conductor. The invention further relates to an electrical plug connector having a contact element (3), which is characterized in that the contact element (3) comprises a carrier element (4) coated with an electrically conductive material, wherein the coating (6) forms the only electrical signal conductor.

8 Claims, 1 Drawing Sheet

(58) Field of Classification Search
USPC ..... 439/736
See application file for complete search history.

(56) References Cited

U.S. PATENT DOCUMENTS 5,264,788 A * 11/1993 Smith ..... G01R 1/06 324/72.5
5,703,324 A * 12/1997 Harder ..... H01R 24/28 174/210
6,615,483 B2 9/2003 Lindegren
7,390,963 B2 * 6/2008 Scherer ..... C22C 47/08 174/120 R
7,618,294 B1 * 11/2009 Lin ..... H01R 13/701 200/51 R
7,833,055 B2 * 11/2010 Crooijmans ..... H01R 24/58 439/604
7,927,151 B2 * 4/2011 Prest ..... H01R 13/035 439/669
7,955,144 B2 * 6/2011 Thoerner ..... H01R 24/28 439/825
8,142,230 B2 * 3/2012 Li ..... H04R 1/1025 439/638
8,162,697 B1 * 4/2012 Menolotto ..... H01R 13/7031 439/669
8,247,036 B2 * 8/2012 Jiang ..... H01B 13/0162 204/192.1
2003/0207603 A1 * 11/2003 Potega ..... H01R 24/58 439/218
2004/0009702 A1 * 1/2004 Potega ..... H01R 24/58 439/578
2006/0105641 A1 * 5/2006 Rehbein ..... H01R 13/03 439/886
2006/0162287 A1 7/2006 Hasegawa
2007/0275611 A1 * 11/2007 Rehbein ..... H01R 4/58 439/886
2009/0196982 A1 * 8/2009 Jiang ..... H01B 13/0162 427/113
2009/0196985 A1 * 8/2009 Jiang ..... H01B 1/04 427/118
2011/0045711 A1 * 2/2011 Thoerner ..... H01R 4/36 439/750
2013/0009544 A1 * 1/2013 McCutcheon ..... H05B 33/145 313/509
2013/0206461 A1 * 8/2013 Sullivan Malervy .. B82Y 30/00 174/257
2013/0260048 A1 10/2013 Russegger
2014/0162506 A1 * 6/2014 De Cloet ..... H01B 1/02 439/886
2015/0295370 A1 * 10/2015 Saari ..... H01R 24/58 439/669
2015/0333458 A1 * 11/2015 Hallsten ..... H01R 24/58 439/39
2015/0340820 A1 * 11/2015 Joschika ..... H01R 13/17 439/669

OTHER PUBLICATIONS

Written Opinion of the International Search Authority (Form PCT/ISA/237) with English Translation issued in the corresponding PCT International Application No. PCT/EP2015/051578, dated May 29, 2015 (15 pages).
International Preliminary Report on Patentability Chapter I issued in the corresponding PCT International Application No. PCT/EP2015/051578, dated Aug. 2, 2016 (8 pages).

* cited by examiner

METHOD FOR PRODUCING A CONTACT ELEMENT

The invention relates to a method for producing a contact element of an electrical plug connector. The invention moreover relates to an electrical plug connector having such a contact element.

In order to meet the requirements in terms of electrical and mechanical function of contact elements in electrical plug connectors, use is predominantly made of contact elements which comprise a very large quantity of conductive mass, with the result that eddy currents are often the consequence. Various methods for producing contact elements of electrical plug connectors are known from the prior art. In the case of the known plug connectors, the contact element is usually produced as a turned part made of a material which on the one hand is suitable for machining and on the other hand is electrically conductive. It is disadvantageous in this respect that a material suitable for machining usually has a lower conductivity than, for example, the conductive material of the conductor to be connected (e.g. copper). This requires greater line and contact cross sections in order to prevent the quality-reducing attenuation of power pulses. Furthermore, a pronounced skin effect arises in the case of contact elements formed in this way. By virtue of the skin effect, the current density is lower in the interior of a conductor than in outer regions. With an increasing frequency of the transmitted signals, the skin effect increases the resistance per unit length of the electrical line.

Eddy currents which are induced in the contact elements of plug connectors by the transmitted signals can similarly be disadvantageous for the quality of the signal transmission, since the eddy currents interfere with the signal currents. In order to keep eddy currents as small as possible, it is known to use materials with a high conductivity, such as copper and silver. On account of the good conductivity of these materials, the material volume of the contact elements can be reduced considerably. Eddy currents correspondingly arise to a reduced extent. Contact elements made of silver are mostly used in plug connectors having a composite structure of metal and plastic, the contact elements being produced as stamped/bent parts which are embedded in the plastic material of a main body of the plug connector (e.g. by encapsulation in an injection molding method). It is also advantageous in this respect that coupling and line capacities can be reduced on account of the greatly reduced mass of the electrically conductive material (see e.g. DE 10 2008 007 866 A1).

It is an object of the invention to provide a further improved contact element for an electrical plug connector. It should be possible for the electrical plug connector to be produced in a cost-effective and simple manner. Moreover, at least the frequency-dependent skin effect should be eliminated to the greatest possible extent and the formation of eddy current should be avoided.

This object is achieved by a method having the features of claim 1 and also by an electrical plug connector having the features of claim 12. Advantageous configurations are the subject matter of the dependent claims. It is to be noted that the features specified individually in the claims can be combined with one another as desired and therefore demonstrate further configurations of the invention.

The method according to the invention for producing a contact element of an electrical plug connector comprises at least the following steps:

providing an electrically non-conductive carrier element, and coating the carrier element with an electrically conductive material, wherein the produced coating forms the only electrical signal conductor.

The method according to the invention makes it possible to produce contact elements which have a greatly reduced mass of the electrically conductive material compared to the prior art. As a result of this, they have an outstanding behavior with respect to eddy current, and the quality of the signal transmission can thereby be improved. Since the electrically conductive coating has only a very small cross section, the frequency-dependent (non-linear) skin effect can additionally be ruled out almost completely.

The invention is based on the concept of using a crystalline conductor. The coating is preferably embodied as a two-dimensional crystalline layer. It is generally known that crystals are distinguished by their regular arrangement of atoms in all three directions in space. In contrast thereto, the conductors which are preferred according to the invention preferably have a regular or repetitive arrangement of the atoms only in two directions in space. The physical properties of two-dimensional crystalline layers differ significantly from the amorphous form of the same material.

Established coating methods, such as e.g. vapor deposition methods (PVD, CVD), can be used for applying the electrically conductive coating.

According to the invention, the carrier element is excluded from the signal line. The carrier element may consist of a plastic material, the carrier element preferably being produced from a suitable thermoplastic polymer material of a type known per se in an injection molding method. The injection molding method makes it possible for directly usable shaped parts to be produced cost-effectively in a large quantity. It is also conceivable, however, for the carrier element to consist of a ceramic material.

The carrier element may advantageously consist of an anodized metallic material. The metallic carrier body, which is initially suitable itself as a signal conductor, is electrically insulated by the anodizing and therefore excluded from the signal line. An electrically insulating ceramic layer is preferably produced on the surface of the carrier element by the anodizing. Ceramic materials are generally known in electronics and electrical engineering. They are particularly suitable as insulators owing to their high mechanical load-bearing capacity and very low electrical conductivity. All known methods are suitable for producing the ceramic layer according to the invention.

The carrier element advantageously consists of aluminum or an aluminum alloy. Carrier elements formed in this way can be produced using tools which are already used for producing contact elements. It is thereby possible to reduce costs. Cost-effective production of the plug connectors according to the invention is thus possible. Aluminum is suitable for anodizing by the Eloxal method.

Furthermore, the carrier element may consist of titanium or a titanium alloy. Through the use of titanium, the signal conductor has a very high strength combined with a low overall weight. It is thereby possible to realize a particularly robust plug connector, the contact elements of which are resistant to bending. Carrier elements consisting of titanium can also be produced using tools which are already used for producing contact elements.

The layer of electrically conductive material is preferably carbon. It is particularly preferable that the coating consists of graphite. Along its crystal layer, graphite has a particularly high strength and a very good electrical conductivity.

On account of the good electrical conductivity, the conductive mass can be minimized. Eddy currents are avoided.

Graphene is advantageously used for coating the carrier element. Graphene surface crystals are particularly rigid and solid and additionally have a very good electrical conductivity. Graphene layers can be produced in extremely thin form, if appropriate as monoatomic layers or layers comprising only a few atomic layers, such that the skin effect is eliminated if the graphene layer forms the only electrical signal conductor within the context of the invention. The graphene coating can be realized by epitaxial growth on the material of the anodized carrier element by means of vapor deposition.

The carbon layer is advantageously produced by plasma coating of the carrier element. The plasma coating affords the advantage that good adhesion with respect to the substrate can be achieved as a result. Furthermore, a high degree of uniformity of the layer thickness and structure is achieved and the surface and layer properties can be set in a targeted manner within wide limits. Particularly the uniformity of the layer thickness plays a decisive role with respect to a skin effect, which is to be kept as small as possible or avoided completely according to the invention. Rough surfaces have an unfavorable effect on the electrical resistance (contact and line resistance). Furthermore, layers produced in this way are free of holes combined with a low thickness. Plasma coating is also advantageous in terms of ecological aspects, since this is a solvent-free and dry process with only little use of chemicals.

It is also conceivable, however, that the carrier element is coated with titanium nitride. In addition to its function as a signal conductor, the titanium nitride layer also ensures, by virtue of its hardness, a high strength of the plug connector, as a result of which the plug connector is in particular more resistant to bending. An additional advantage of the titanium nitride layer is also its high scratch resistance. This prevents the formation of recesses in the otherwise planar surface caused by the use or during the use of the plug connector; these recesses would have an unfavorable effect on the electrical resistance (contact and line resistance) and would lead to worsening of the behavior in terms of eddy current. A durable and high-quality plug connector is thereby provided. Conventional coating methods, such as e.g. the vapor deposition method (CVD/PVD) or else plasma coating, can be used for applying the titanium nitride. Depending on the coating method used, an extremely thin and uniform titanium nitride layer can thereby be produced, such that the skin effect is eliminated.

In a preferred configuration of the invention, it is provided that an electrically conductive protective coating is applied to the coating. The protective coating protects the underlying layers against mechanical and chemical influences, such as for example abrasion and/or oxygen.

The protective coating contains an electrically conductive material. By way of example, the protective layer may consist of gold or another material with sufficiently good electrical conductivity.

Titanium nitride is particularly readily suitable as the protective coating. The ceramic material is a hard material and a good electrical conductor. Furthermore, titanium nitride has good sliding properties, this being advantageous when plugging electrical plug connectors together. The use of titanium nitride leads moreover to an appealing external appearance of the plug connector, since a smooth titanium nitride layer is colored black with a high gloss or is colored gold or displays interference color effects.

The contact element according to the invention can also be encapsulated or encapsulated by injection molding at least partially by a main body of the plug connector. The main body preferably consists of a plastic.

Furthermore, the contact elements produced according to the invention can be integrated into types of plug connectors which are already known. It is therefore not necessary to completely convert the existing production processes. This reduces costs.

The present invention also relates to an electrical plug connector having a contact element produced in the manner described above. The electrical plug connector according to the invention having a contact element is distinguished by the fact that the contact element comprises an electrically insulating carrier element coated with an electrically conductive material, wherein the coating forms the only electrical signal conductor.

The plug connectors according to the invention are preferably formed in such a manner that no tools are required for plugging the plug connectors or the contact element into a corresponding bushing or the like, or for removing them therefrom again.

On account of the greatly reduced mass of the electrically conductive material compared to the prior art, a plug connector formed in this way has the advantage that it has an outstanding behavior in terms of eddy current, as a result of which the quality of the signal transmission can be improved. Since the conductive elements of the plug connector according to the invention have only a very small cross section, the frequency-dependent (non-linear) skin effect can also be ruled out almost completely according to the invention.

The carrier element may consist of a plastic material and is preferably embodied as an injection-molded part. The injection molding method makes it possible for directly usable shaped parts to be produced cost-effectively in a large quantity.

It is furthermore conceivable that the carrier element is embodied as a stamped/bent part. The carrier element can preferably be produced from anodized flat metallic material. Deformation by bending provides the carrier element with the shape required for operation. Material and therefore costs are saved as a result of carrier elements formed in this way.

The contact element can be embedded at least partially in a main body made of electrically insulating material. The main body forms the supportive structure of the plug connector. The main body preferably consists of a plastic material. In order to ensure a form-fitting and fixed connection between the contact element and the main body, the contact element may have recesses, into which the insulating body engages.

The contact element may advantageously be embedded in the material of the main body by encapsulation. The contact element is preferably embedded in the main body by injection molding. A plug connector formed in this way is optimized both in terms of its electrical properties for signal transmission and in terms of production costs.

The plug connector according to the invention may be, for example, a banana plug, a cinch plug, an XLR plug, an HDMI plug, a pole terminal or a cable shoe.

Exemplary embodiments of the invention and also the technical context will be explained in more detail hereinbelow on the basis of the drawings. The invention is not limited to the exemplary embodiments shown.

Figure 1:
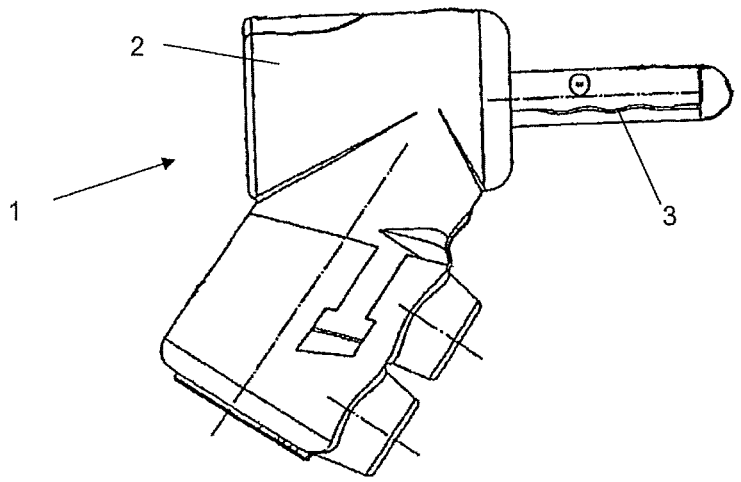
FIG. 1 shows a schematic side view of an electrical plug connector according to the invention.

FIG. 1 shows a schematic side view of an electrical plug connector according to the invention. The electrical plug connector 1 is in the form of an angled banana plug and comprises a main body 2 and also a substantially cylindrical contact element 3 emerging on the front side of the main body 2. The contact element 3 is partially embedded in the main body 2 consisting of plastic. The contact element 3 comprises at least one carrier element 4, which is coated with an electrically conductive layer consisting preferably of graphene, the coating forming the only electrical signal conductor. The carrier element 4 is produced in this case from a flat metallic material, which obtains the shape required for operation, as is shown in FIG. 1, by deformation by bending. The carrier element 4 is a stamped/bent part made of aluminum which is anodized in an Eloxal method and then coated with graphene. The carrier element 4 may also be a body made of plastic, however. It is essential that the carrier element 4 is not electrically conductive, i.e. either consists of electrically insulating material or is coated therewith. It therefore does not take part in the electrical signal transmission and acts so to speak only as a dummy core.

Figure 2:
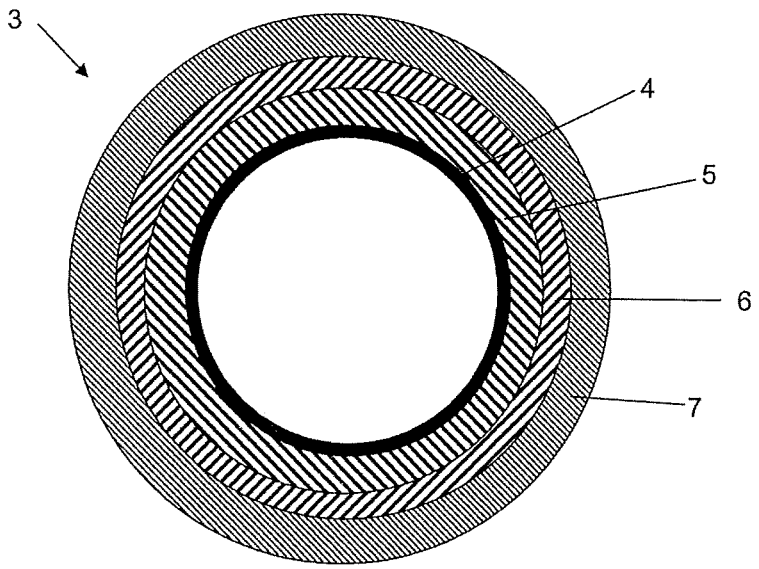
FIG. 2 shows a schematic sectional illustration of a contact element according to the invention.

FIG. 2 shows a schematic sectional illustration of the contact element 3. The carrier element 4 consists of a metallic material and is surrounded by a ceramic layer 5 produced by anodizing. The ceramic layer 5 electrically insulates the carrier element 4. The ceramic layer 5 is covered by an electrically conductive layer 6, this preferably being a carbon layer, which according to the invention forms the only signal conductor. The coating 6 in this case has the smallest possible layer thickness. In order to protect the contact element 3 against external influences, such as air and abrasion, the contact element 3 has, as the outer layer, a protective coating 7 made of titanium nitride.

The invention claimed is:

1. A method for producing an electrical plug connector (1), said method comprising:

producing a contact element (3) by providing an electrically non-conductive carrier element (4), and coating the carrier element (4) with an electrically conductive material, wherein the electrically conductive coating (6) forms the only electrical signal conductor so as to reduce a skin effect, and wherein the electrically conductive coating (6) further comprises one or more of a carbon layer, a graphene layer, and a graphite layer, or, said electrically conductive coating (6) further comprises a titanium nitride, and casting around the contact element (3) so as to at least partially embed the contact element (3) in a main body (2) portion of the connector (1).

2. The method of claim 1, further comprising: forming the carrier element (4) from a plastic.

3. The method of claim 1, further comprising: forming carrier element (4) from an anodized metallic material, thereby electrically insulating the carrier element (4).

4. The method of claim 3, further comprising: forming carrier element (4) from aluminum or an aluminum alloy.

5. The method of claim 3, further comprising: forming carrier element (4) from titanium or a titanium alloy.

6. The method of claim 1, further comprising: producing the electrically conductive coating (6) by plasma coating the carrier element (4).

7. The method of claim 1, further comprising: applying an electrically conductive protective coating (7) to the electrically conductive coating (6).

8. The method of claim 7, further comprising: forming the protective coating (7) from titanium nitride.

* * * * *